US007416578B2

(12) United States Patent
Ahlin et al.

(10) Patent No.: US 7,416,578 B2
(45) Date of Patent: Aug. 26, 2008

(54) POWDER METAL COMPOSITION

(75) Inventors: Åsa Ahlin, Höganäs (SE); Maria Ramstedt, Helsingborg (SE)

(73) Assignee: Höganäs AB, Höganäs (SE)

( * ) Notice: Subject to any disclaimer, the term of this patent is extended or adjusted under 35 U.S.C. 154(b) by 252 days.

(21) Appl. No.: 11/228,257

(22) Filed: Sep. 19, 2005

(65) Prior Publication Data

US 2006/0112783 A1 Jun. 1, 2006

Related U.S. Application Data

(60) Provisional application No. 60/621,805, filed on Oct. 26, 2004.

(30) Foreign Application Priority Data

Sep. 17, 2004 (SE) ..... 0402239
Jan. 12, 2005 (SE) ..... 0500072

(51) Int. Cl.
*B22F 1/00* (2006.01)
*B22F 1/02* (2006.01)
*B22F 3/00* (2006.01)

(52) U.S. Cl. ..... 75/252; 419/35; 419/36; 419/37

(58) Field of Classification Search ..... 75/252; 419/35, 36, 37
See application file for complete search history.

(56) References Cited

U.S. PATENT DOCUMENTS 5,338,508 A 8/1994 Nitta et al.
5,627,258 A * 5/1997 Takayama et al. ..... 528/338
6,348,265 B1 2/2002 Jansson et al.
6,537,389 B1 3/2003 Aichele et al.
6,926,963 B2 * 8/2005 Ohmori et al. ..... 428/403
6,979,409 B2 * 12/2005 Chen et al. ..... 252/62.54
2002/0084440 A1 7/2002 Ohmori et al.
2004/0005479 A1 1/2004 Kitamura et al.

FOREIGN PATENT DOCUMENTS

EP 0 589 088 A1 3/1994
EP 1197975 A1 4/2002
EP 1205949 5/2002
EP 1276119 B1 6/2007
WO WO94/02273 A1 2/1994
WO WO01/22448 3/2001

* cited by examiner

*Primary Examiner*—Roy King
*Assistant Examiner*—Ngoclan T Mai
(74) *Attorney, Agent, or Firm*—Buchanan Ingersoll & Rooney PC

(57) ABSTRACT

The invention concerns a powder metal composition comprising an iron based powder and a lubricant and/or binder comprising at least one secondary amide of the general formula: $R_1$—NH—CO—$R_2$, wherein $R_1$ and $R_2$ are the same or different, straight or branched, saturated or unsaturated aliphatic hydrocarbon groups. The invention further concerns a method of making green bodies of the powder metal composition according to the invention, a method of producing a bonded iron-based powder composition, as well as the use of the at least one secondary amide as a lubricating and/or binding agent for iron based powders and the use as a die wall lubricant.

Figure 1:
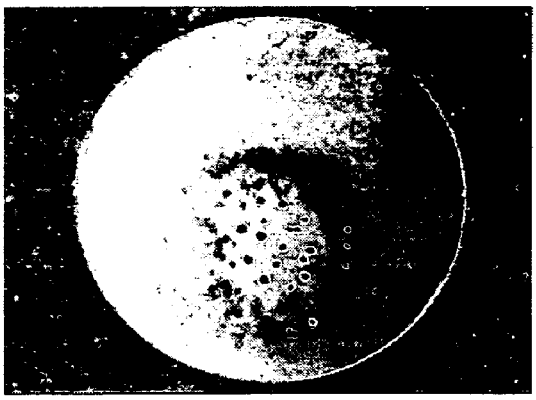
Figure 1:
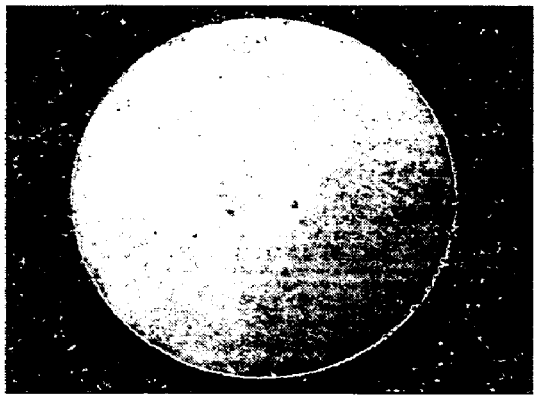

20 Claims, 1 Drawing Sheet a) Ethylene bisstearamide (EBS)

b) Oleyl palmitamide

POWDER METAL COMPOSITION

The benefit is claimed under 35 U.S.C. § 119(a)-(d) of Swedish Application No. 0402239-8, filed Sep. 17, 2004 and Swedish Application No. 0500072-4, filed Jan. 12, 2005, and under 35 U.S.C. 119(e) of the U.S. Provisional Application No. 60/621,805, filed Oct. 26, 2004.

FIELD OF THE INVENTION

The present invention concerns a powder metal composition. Specifically the invention concerns a powder metal composition including a lubricant and/or binder comprising at least one secondary amide. The invention further concerns a method of producing a green body, a method of producing a bonded iron-based powder composition and use of the lubricant and/or binder.

BACKGROUND OF THE INVENTION

Metal powders are used in industry for the manufacture of metal products by compacting the metal powder in a die under high pressures, ejecting the compact from the die and optionally sintering the product. In the majority of powder metallurgical (PM) applications a lubricant is comprised in the powder in order to provide the necessary lubrication action between powder particles during compaction and between the die and the compact during ejection from the die. Lubrication achieved by a lubricant included in the metal powder is referred to as internal lubrication in contrast to external lubrication, which is achieved by applying a lubricant to the walls of the die, wherein the powder is compacted. Insufficient lubrication during ejection results in excessive friction between the compact and the die resulting in high ejection energies and damage of die surfaces and product surfaces.

Internal lubrication is achieved by using special lubricants. Normally these lubricants are admixed with the iron or iron-based powder in the form of a powder. Some lubricants may also be used for binding additives, such as e.g. alloying elements, to the iron or iron-based particles. In these cases the lubricants thus work as binding agents and reduce or eliminate segregation of the additives during shipping and handling.

Commonly used lubricants for PM applications are metal soaps, such as lithium and zinc stearate. A disadvantage with this type of lubricant is that oxides of the metals in the lubricant contaminate the inside of the sintering furnace as a result of release of metals from the lubricant during sintering, another problem is that stains may be formed on the component after sintering. Another commonly used lubricant is ethylene bis stearamide (EBS). Stains may also be formed on the component after sintering when using this lubricant, but to a lesser extent compared with using e.g. zinc stearate. As lubricants strongly affect compacting and sintering properties of metal powders optimization of amount, composition and structure of the used lubricant is of vital importance to obtain high and consistent densities and good surface finishes of the produced parts.

OBJECTS OF THE INVENTION

An object of the present invention is to provide a new powder metal composition comprising a lubricant and/or binder that reduces or eliminates the problems with high ejection forces and stained surfaces of the sintered parts.

Further objects of the invention are to provide a method of producing compacted products and sintered or heat treated parts, a method of producing a bonded powder metal composition and use of the lubricant and/or binder.

SUMMARY OF THE INVENTION

These objects are accomplished by a powder metal composition comprising an iron based powder and a lubricant and/or binder comprising at least one secondary amide. The invention further concerns a method of producing a green body by subjecting the above mentioned composition to compaction.

The method of producing a bonded powder metal composition comprises: mixing an iron-based powder with at least one secondary amide and heating the mixture to a temperature above the melting point of the at least one secondary amide.

Additionally, the invention concerns the use of the at least one secondary amide as a lubricating and/or binding agent for iron-based powders, and its use for die wall lubrication.

DETAILED DESCRIPTION OF THE INVENTION

The lubricant and/or binder in the powder metal composition according to the invention is at least one secondary amide that may be defined by the general formula:

$$R_1—NH—CO—R_2,$$

wherein the $R_1$- and $R_2$-groups, which may be the same or different, are straight or branched, saturated or unsaturated aliphatic hydrocarbon groups.

Preferably, $R_1$ and $R_2$ independently include 10 to 24 carbon atoms.

Preferably $R_1$ and $R_2$ are selected from the group consisting of alkyl and alkenyl.

The alkyl groups may be chosen from decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl.

The alkenyl groups may be chosen from decenyl, undecenyl, dodecenyl, tridecenyl, tetradecenyl, pentadecenyl, hexadecenyl, heptadecenyl, octadecenyl, nonadecenyl, eicosenyl, heneicosenyl, docosenyl, tricosenyl, tetracosenyl.

Examples of preferred secondary amides are shown in Table 1.

TABLE 1

General formula: $R_1$—NH—CO—$R_2$

| $R_1$ no of C-atoms | $R_2$ no of C-atoms | $R_1$ | $R_2$ | Chemical name | Chemical structure | Common name |
|---|---|---|---|---|---|---|
| 18 | 15 | Octadecenyl | Pentadecyl | Octadecenylhexadecaneamide | $CH_3(CH_2)_7HC{=}CH(CH_2)_8NHCO(CH_2)_{14}CH_4$ | Oleyl palmitamide |
| 18 | 17 | Octadecyl | Heptadecyl | Octadecyloctadecaneamide | $CH_3(CH_2)_{17}NHCO(CH_2)_{16}CH_3$ | Stearyl stearamide |

TABLE 1-continued

General formula: $R_1$—NH—CO—$R_2$

| $R_1$ no of C-atoms | $R_2$ no of C-atoms | $R_1$ | $R_2$ | Chemical name | Chemical structure | Common name |
|---|---|---|---|---|---|---|
| 18 | 17 | Octadecenyl | Heptadecyl | Octadecenyloctadecaneamide | $CH_3(CH_2)_7HC{=}CH(CH_2)_8NHCO(CH_2)_{16}CH_3$ | Oleyl stearamide |
| 18 | 17 | Octadecyl | Heptadecenyl | Octadecyloctadeceneneamide | $CH_3(CH_2)_{17}NHCO(CH_2)_7HC{=}CH(CH_2)_7CH_3$ | Stearyl oleamide |
| 18 | 17 | Octadecenyl | Heptadecenyl | Octadecenyloctadeceneneamide | $CH_3(CH_2)_7HC{=}CH(CH_2)_8NHCO(CH_2)_7HC{=}CH(CH_2)_7CH_3$ | Oleyl oleamide |
| 18 | 21 | Octadecyl | Heneicocenyl | Octadecyldoceneneamide | $CH_3(CH_2)_{17}NHCO(CH_2)_{11}HC{=}CH(CH_2)_7CH_3$ | Stearyl erucamide |
| 18 | 21 | Octadecenyl | Heneicocenyl | Octadecenyloctadeceneneamide | $CH_3(CH_2)_7HC{=}CH(CH_2)_8NHCO(CH_2)_{11}HC{=}CH(CH_2)_7CH_3$ | Oleyl erucamide |
| 22 | 17 | Dococenyl | Heptadecyl | Dococenyloctadecaneamide | $CH_3(CH_2)_7HC{=}CH(CH_2)_{12}NHCO(CH_2)_{16}CH_4$ | Erucyl stearamide |
| 22 | 17 | Dococenyl | Heptadecenyl | Dococenyloctadeceneneamide | $CH_3(CH_2)_7HC{=}CH(CH_2)_{12}NHCO(CH_2)_7HC{=}CH(CH_2)_7CH_3$ | Erucyl oleamide |
| 22 | 21 | Dococenyl | Heneicocenyl | Dococenyldoceneneamide | $CH_3(CH_2)_7HC{=}CH(CH_2)_{12}NHCO(CH2)_{11}HC{=}CH(CH2)_7CH_3$ | Erucyl erucamide |
| 24 | 11 | Tetracosyl | Undecyl | Tetracocyldodecaneamide | $CH_3(CH_2)_{23}NHCO(CH2)_{10}CH_3$ | Lignoceryl lauramide |
| 24 | 17 | Tetracosyl | Heptadecyl | Tetracocyloctadecaneamide | $CH_3(CH_2)_{23}NHCO(CH_2)_{16}CH_3$ | Lignoceryl stearamide |

The amount of secondary amides may constitute 0.05-2.0% by weight of the powder metal composition, preferably 0.05-1.0% by weight.

One embodiment of the invention concerns a powder metal composition comprising a lubricant and/or binder further comprising at least one primary amide in addition to the at least one secondary amide. The at least one primary amide is preferably a saturated or unsaturated fatty acid amide having 12-24, preferably 14-22 C-atoms and most preferably 16-22 C-atoms.

Especially preferred primary amides are stearic acid amide (stearamide), behenic acid amide (behenamide), eurcic acid amide (erucamide), palmitic acid amide (palmitamide) and arachidic acid amide (arachidamide).

The primary and secondary amides according to the invention are either commercially obtainable or may be produced from commercially obtainable material by the use of processes well known in the art.

The amount of primary and secondary amides may constitute a total of 0.05-2.0% by weight of the powder metal composition, preferably 0.05-1.0% by weight.

The amount of the at least one primary amide may be 0.05-1.0% by weight and the amount of the at least one secondary amide may be 0.05-1.0% by weight for the embodiment of the invention comprising both types of amides.

The lubricant and/or binder may be added to the powder metal composition in the form of solid particles of each amide. The average particle size may vary, but is preferably less than 150 μm.

Alternatively, the lubricant and/or binder may be added to the powder metal composition as a molten and subsequently solidified particulate mixture of the amides. This may be accomplished by mixing the amides in a predetermined ratio, the mixture is then melted, cooled and subsequently milled to a lubricant powder.

The at least one secondary amide according to the invention may be used as a binder for obtaining a bonded mixture, wherein optional alloying elements and the at least one secondary amide are bonded to the iron-based powder. This may be achieved by mixing an iron-based powder with at least one secondary amide according to the invention, and heating the mixture to a temperature above the melting point of the at least one secondary amide. At least one primary amide may further be mixed into the above mentioned mixture and the heating temperature may then be lower than the melting point of the primary amide.

Apart from the lubricant and/or binder disclosed above, the powder metal composition according to the invention may, if so desired, contain other lubricants, such as zinc stearate, lithium stearate, EBS etc.

To accomplish a bonding of the powder metal composition according to the invention other types of bonding systems may be used such as alkydes, cellulose ester resins, hydroxyalkyl cellulose resins having 1-4 carbon atoms in the alkyl group, or thermoplastic phenolic resins.

As used in the description and the appended claims, the expression "iron-based" powder encompasses powder essentially made up of pure iron, iron powder that has been prealloyed with other elements improving the strength, the hardening properties, the electromagnetic properties or other desirable properties of the end products and particles of iron mixed with particles of such alloying elements (diffusion annealed mixture or purely mechanical mixture). Examples of alloying elements are copper, molybdenum, chromium, manganese, phosphorous, carbon in the form of graphite, nickel, silicon, boron, vanadium, titanium, aluminium, cobalt and tungsten, which are used either separately or in combination, e.g. in the form of compounds ($Fe_3P$ and FeMo).

The iron based powders may be used for the preparation of soft magnetic parts and may, for this application, be electrically insulated. Electrical insulation of the powder particles may be made of an inorganic material. Especially suitable are the type of insulation disclosed in the U.S. Pat. No. 6,348,265, which concerns particles of a base powder consisting of essentially pure iron having an insulating oxygen- and phosphorus-containing barrier. Insulated powder particles are available as Somaloy™ 500 and 550 from Hoganas AB, Sweden.

Apart from the iron-based powder and the lubricant and/or binder, the powder metal composition according to the invention may contain one or more additives selected from the group consisting of processing aids and hard phases.

The processing aids used in the powder metal composition may consist of talc, forsterite, manganese sulphide, sulphur, molybdenum disulphide, boron nitride, tellurium, selenium, barium difluoride and calcium difluoride, which are used either separately or in combination.

The hard phases used in the powder metal composition may consist of carbides of tungsten, vanadium, molybdenum, chromium, $Al_2O_3$, $B_4C$ and various ceramic materials.

The invention further concerns a method of producing a green body comprising: compacting the powder metal composition according to the invention to a compacted body, wherein the composition comprises an iron based powder and a lubricant and/or binder comprising at least one secondary amide having the general formula: $R_1$—NH—CO—R2, wherein $R_1$ and $R_2$ are the same or different, straight or branched, saturated or unsaturated aliphatic hydrocarbon groups. The compacted body may be sintered or heat-treated.

With the aid of conventional techniques, the iron-based powder, the lubricant and/or binder and optional additives may be mixed to a substantially homogeneous powder composition before the compaction step.

The powder metal composition and/or the die may be preheated before the compaction.

The invention further concerns the use of at least one secondary amide, defined as above, as a lubricating and/or binding agent for iron or iron based powders.

A further embodiment of the invention concerns the use of at least one secondary amide, defined as above, as a die wall lubricant.

DETAILED DESCRIPTION OF THE FIGURE

FIG. 1 shows stain formation of components after sintering due to the use of different lubricants.

1a) Ethylene bisstearamide (EBS);

1b) Oleyl palmitamide (a secondary amide according to the invention).

The invention will now be further described with the following unlimiting examples.

EXAMPLES

In the following examples lubricants having the formulas disclosed in Table 2 below have been used.

TABLE 2

| Chemical name | Structural formula* | | Amide type |
|---|---|---|---|
| Ref: Ethylene bis stearamide (EBS) | $CH_3(CH_2)_{16}CONH(CH_2)_2NHCO(CH_2)_{16}CH_3$ | | bis amide |
| Stearamide (S) | $CH_3(CH_2)_{16}CONH_2$ | | Primary |
| Arachid-amide (A) | $CH_3(CH_2)_{18}CONH_2$ | | Primary |
| Erucamide (E) | $CH_3(CH_2)_7CH{=}CH(CH_2)_{11}CONH_2$ | | Primary |
| Behenamide (B) | $CH_3(CH_2)_{20}CONH_2$ | | Primary |
| Stearyl Stearamide (SS) | R1 = C18:0 | R2 = C17:0 | Secondary |
| Erucyl Stearamide (ES) | R1 = C22:1 | R2 = C17:0 | Secondary |
| Oleyl Palmitamide (OP) | R1 = C18:1 | R2 = C15:0 | Secondary |
| Stearyl Erucamide (SE) | $R_1$ = C18:0 | $R_2$ = C21:1 | secondary |
| Oleyl Stearamide (OS) | $R_1$ = C18:1 | $R_2$ = C17:0 | secondary |
| Stearyl Oleamide (SO) | R = C18:0 | $R_2$ = C17:1 | secondary |

*The structural formulas for the secondary amides are referring to $R_1$—NH—CO—$R_2$ as previously described.

Example 1

This example demonstrates the lubrication properties of different secondary amides and different combinations of secondary and primary amides, which are added as a powder in iron-based powder mixes.

Base powder ASC 100.29 (available from Hoganas AB, Sweden) was mixed with 0.5% by weight of graphite (uf-4 from Kropfmuhl) and 0.8% by weight of lubricants, according to Table 3 and 4, in a Lödige mixer for 2 minutes. Ethylene bisstearamide (EBS, available as Licowax™ from Clariant, Germany) was used as a reference. The lubricants had a particle size less than 150 μm. Compositions comprising both a secondary and a primary amide contained 50% of each amide (0.8% by weight of the total composition).

In order to measure the lubricating properties rings with an inner diameter of 45 mm, an outer diameter of 55 mm and a height of 10 mm were compacted at ambient temperature at three different compaction pressures (400, 600 and 800 MPa). During ejection of the compacted parts the ejection force was recorded. The green density of the parts was measured after ejection and the total ejection energy/enveloping area needed in order to eject the samples from the die was calculated.

The resulting ejection energies and densities are shown in Table 3 and 4. Lower ejection energies where achieved when using the powder metal composition according to the invention compared with the use of the reference composition comprising EBS.

TABLE 3

Densities and ejection energies (secondary amides and reference).

| | Premixed | | | | | |
|---|---|---|---|---|---|---|
| | Green Density ($g/cm^3$) | | | Ejection Energy ($J/cm^2$) | | |
| Lubricant | 400 MPa | 600 MPa | 800 MPa | 400 MPa | 600 MPa | 800 MPa |
| EBS (Ref) | 6.70 | 7.04 | 7.17 | 19.2 | 26.1 | 28.2 |
| SS | 6.72 | 7.06 | 7.19 | 17.6 | 24.7 | 27.9 |
| ES | 6.78 | 7.12 | 7.23 | 16.3 | 20.3 | 20.8 |
| OP | 6.78 | 7.14 | 7.25 | 16.7 | 21.3 | 20.3 |
| SE | 6.78 | 7.13 | 7.24 | 16.8 | 21.9 | 21.8 |
| OS | 6.78 | 7.13 | 7.24 | 17.7 | 21.3 | 20.5 |
| SO | 6.79 | 7.13 | 7.23 | 15.9 | 21.4 | 20.4 |

TABLE 4

| Densities and ejection energies (secondary + primary amides 1:1 and reference) | | | | | | |
|---|---|---|---|---|---|---|
| | Premixed | | | | | |
| | Green Density ($g/cm^3$) | | | Ejection Energy ($J/cm^2$) | | |
| Lubricant | 400 MPa | 600 MPa | 800 MPa | 400 MPa | 600 MPa | 800 MPa |
| EBS (Ref) | 6.70 | 7.04 | 7.17 | 19.2 | 26.1 | 28.2 |
| SS + E | 6.69 | 7.06 | 7.21 | 19.1 | 24.2 | 23.6 |
| OP + S | 6.70 | 7.06 | 7.19 | 18.2 | 22.1 | 22.3 |
| ES + S | 6.71 | 7.06 | 7.19 | 17.9 | 21.5 | 21.8 |
| ES + E | 6.72 | 7.11 | 7.23 | 17.8 | 20.7 | 19.0 |

Example 2

The base powder ASC 100.29 was mixed with 2% by weight of Copper (−100 μm), 0.8% by weight graphite and 0.8% by weight of lubricants (a) EBS or b) oleyl palmitamide) in a Lödige mixer for 2 minutes. The lubricants had a particle size less than 150 μm. In order to measure the stain formation after sintering of components, cylindrical components with a diameter of 64 mm and a height of 32 mm were compacted to a green density of 7.1 $g/cm^3$ at ambient temperature. The weight of one cylinder was 700 g. The components were sintered in an atmosphere containing 90/10 $N_2/H_2$ at 1120° C. for 15 minutes. Photos of the components are shown in FIG. 1*a*) Ethylene bisstearamide (EBS) and 1*b*) oleyl palmitamide, in which FIG. 1*a*) show stain formation in contrast to the part produced from the powder composition according to the present invention (1*b*) which has no stains.

Example 3

This example demonstrates the lubrication properties of different combinations of secondary and primary amides, which have been melted together, cooled and milled before being mixed with iron-based powder mixes.

The lubricant combinations were made according to following method: The mixed lubricants, 50% primary and 50% secondary amide, were melted together at 80-110° C. and then cooled. Then the materials were milled to a mean particle size of below 150 μm.

The base powder ASC100.29 was mixed with 0.5% by weight of graphite and 0.8% by weight of lubricant combination (see Table 5), in a Lödige mixer for 2 minutes. In order to measure the lubricating properties rings with inner diameter of 45 mm, outer diameter 55 mm and a height 10 mm were compacted at three different compaction pressures, 400, 600 and 800 MPa at ambient temperature. The resulting ejection energies and densities are shown in Table 5.

TABLE 5

| Densities and ejection energies (secondary + primary amides and reference). | | | | | | |
|---|---|---|---|---|---|---|
| | Melted and solidified | | | | | |
| | Green Density ($g/cm^3$) | | | Ejection Energy ($J/cm^2$) | | |
| Lubricant | 400 MPa | 600 MPa | 800 MPa | 400 MPa | 600 MPa | 800 MPa |
| EBS (Ref) | 6.70 | 7.04 | 7.17 | 19.2 | 26.1 | 28.2 |
| SS + E | 6.70 | 7.06 | 7.20 | 18.8 | 22.4 | 22.6 |
| OP + S | 6.71 | 7.07 | 7.20 | 18.5 | 23.2 | 24.4 |

TABLE 5-continued

| Densities and ejection energies (secondary + primary amides and reference). | | | | | | |
|---|---|---|---|---|---|---|
| | Melted and solidified | | | | | |
| | Green Density ($g/cm^3$) | | | Ejection Energy ($J/cm^2$) | | |
| Lubricant | 400 MPa | 600 MPa | 800 MPa | 400 MPa | 600 MPa | 800 MPa |
| ES + S | 6.71 | 7.07 | 7.20 | 18.9 | 22.7 | 23.5 |
| ES + E | 6.70 | 7.07 | 7.20 | 17.2 | 19.8 | 18.0 |

When comparing the test results in Table 5 it can be seen that samples produced from the powder metal composition according to the invention show lower ejection energies compared to samples produced from the known lubricant EBS.

Example 4

This example demonstrates the lubricating and binding properties of different combinations of amides in powder metal compositions.

The lubricants had a particle size less than 150 μm. The base powder ASC100.29 was mixed with 2% by weight Cu-100, 0.8% by weight of graphite and 0,8% by weight of lubricant/binder combination according to Table 6, in a Lödige mixer for 2 minutes. The mixture with EBS was kept as reference while the mixtures comprising amides were heated to a temperature above the melting point of the secondary amide but below the melting point of the primary amide during mixing in another mixer followed by cooling to accomplish bonding of the additives to the iron powder. In this mixture the secondary amide will thus act as a binder and the primary amide will act as a lubricant. The melting temperatures of the amides are disclosed in Table 7.

Further, the ejection energy was measured on rings having an outer diameter of 55 mm and an inner diameter of 45 mm and a height of 10 mm compacted at three different compaction pressures, 400, 600 and 800 MPa at ambient temperature. The resulting ejection energies and green densities are shown in Table 8.

TABLE 6

| Lubricant/binder combinations for example 4. | |
|---|---|
| Secondary amide 0.2% by weight | Primary amide 0.6% by wt |
| ES | B |
| OP | S |
| OP | B |
| EBS (Ref 1) (0.8% by wt) | |

TABLE 7

| Melting temperatures of the amides. | |
|---|---|
| Amide | Melting temperature(° C.) |
| ES | 72.9 |
| OP | 66.9 |
| B | 101.9 |
| S | 106.6 |

TABLE 8

Densities and ejection energies (primary + secondary amides and reference).

| Binder/Lubricant | Melt bonded Green Density ($g/cm^3$) 400 MPa | 600 MPa | 800 MPa | Ejection Energy ($J/cm^2$) 400 MPa | 600 MPa | 800 MPa |
|---|---|---|---|---|---|---|
| ES + B | 6.75 | 7.06 | 7.19 | 18.5 | 24.6 | 28.1 |
| OP + S | 6.73 | 7.09 | 7.18 | 19.3 | 26.6 | 28.3 |
| OP + B | 6.77 | 7.08 | 7.19 | 19.9 | 25.3 | 27.1 |
| EBS (Ref) | 6.74 | 7.06 | 7.17 | 21.4 | 30.8 | 32.8 |

Samples produced with the aid of the lubricant/binder according to the invention show lower ejection energies compared to samples produced with the lubricant used as reference, i.e. EBS. Use of the powder composition comprising the lubricant/binder according to the invention resulted in compacted sintered parts (sintered in 90/10 $N_2/H_2$ at 1120° C. for 30 minutes) with excellent surface finishes, i.e. essentially without scratches and no stain formation.

Example 5

A coarse soft magnetic iron-based powder, wherein the particles are surrounded by an inorganic insulation was mixed with secondary amide lubricant according to Table 9. As reference lubricants the known substances Zinc-stearate and EBS were used. The particle size distribution of the used iron-based powder is disclosed in Table 10.

The obtained mixes were transferred to a die and compacted into cylindrical test samples (50 g) having a diameter of 25 mm, in an uniaxial press movement at a compaction pressure of 1100 MPa. The die material used was conventional tool steel. During ejection of the compacted samples the ejection force was recorded. The total ejection energy/enveloping area needed in order to eject the samples from the die was calculated.

The results of the measurements regarding ejection energy, green density and surface appearance in the green state are shown in Table 9. Use of the powder metal compositions according to the invention resulted in that compacted components with excellent surface appearance and lower ejection energies were achieved compared with the reference compositions.

TABLE 9

Densities, ejection energies and surface appearance.

| Mix no | Lubricant (0.2 wt %) | Ejection energy ($J/cm^2$) | Green Density ($g/cm^3$) | Surface appearance |
|---|---|---|---|---|
| 1 | ES | 76 | 7.65 | Perfect |
| 2 | SE | 71 | 7.66 | Perfect |
| 3 | SS | 78 | 7.63 | Perfect |
| 4 | OP | 76 | 7.66 | Perfect |
| Ref 1 | Zinc stearate | 117 | 7.66 | Not acceptable |
| Ref 2 | EBS | 113 | 7.64 | Perfect |

TABLE 10

| Particle size (μm) | Coarse powder (wt %) |
|---|---|
| >425 | 0.1 |
| 425-212 | 64.2 |
| 212-150 | 34.1 |
| 150-106 | 1.1 |
| 106-75 | 0.3 |
| 45-75 | 0.2 |
| <45 | 0 |

The invention claimed is:

1. Powder metal composition for compaction when producing powder metal components comprising an iron based powder selected from pure iron, iron powder pre-alloyed, diffusion annealed or mixed with alloying, element(s) selected from Cu, Mo, Cr, Mn, P, C, Ni, Si, B, V, Ti, Al, Co, W, or mixtures thereof and a lubricant and/or binder comprising 0.05-2% by weight of at least one secondary amide of the general formula:

$$R_1—NH—CO—R_2$$

wherein $R_1$ and $R_2$ are the same or different, straight or branched, saturated or unsaturated aliphatic hydrocarbon groups.

2. Composition according to claim 1, wherein $R_1$ and $R_2$ independently include 10 to 24 carbon atoms.

3. Composition according to claim 1 wherein $R_1$ and $R_2$ are selected from the group consisting of alkyl and alkenyl.

4. Composition according to claim 3, wherein the alkyl groups are chosen from decyl, undecyl, dodecyl, tridecyl, tetradecyl, pentadecyl, hexadecyl, heptadecyl, octadecyl, nonadecyl, eicosyl, heneicosyl, docosyl, tricosyl and tetracosyl.

5. Composition according to claim 3, wherein the alkenyl groups are chosen from decenyl, undecenyl, dodecenyl, tridecenyl, tetradecenyl, pentadecenyl, hexadecenyl, heptadecenyl, octadecenyl, nonadecenyl, elcosenyl, heneicosenyl, docosenyl, tricosenyl, and tetracosenyl.

6. Composition according to claim 1, wherein the secondary amide is chosen from oleyl palmitamide, stearyl stearamide, oleyl stearamide, stearyl oleamide, oleyl oleamide, stearyl erucamide, oleyl erucamide, erucyl stearamide, erucyl oleamide, erucyl erucamide, lignoceryl lauramide, and lignoceryl stearamide.

7. Composition according to claim 1, further comprising at least one primary amide.

8. Composition according to claim 7, wherein the primary amide is an amide of a saturated or unsaturated, straight fatty acid having 12-24 carbon atoms.

9. Composition according to claim 7, wherein the primary amide is selected from the group consisting of palmitamide, stearamide, arachidamide, behenamide and erucamide.

10. Composition according to claim 1, wherein the lubricant is particulate.

11. Composition according to claim 7, wherein the lubricant comprises a molten and subsequently solidified particulate mixture of the at least one secondary amide and the at least one primary amide.

12. Composition according to claim 7, wherein the composition is a bonded mixture.

13. Composition according to claim 12, wherein at least one secondary amide is used as a binding agent.

14. Composition according to claim 1, wherein the iron-based particles are surrounded by an insulating inorganic coating.

15. Method of producing a green body comprising: compacting the powder metal composition according to claim 1 to a compacted body.

16. Method according to claim 15, further comprising a heat treatment or sintering step.

17. Method of producing a bonded iron-based powder composition comprising:

mixing an iron-based powder with at least one secondary amide according to claim 1; and heating the mixture to a temperature above the melting point of the at least one secondary amide.

18. Method according to claim 17, wherein the mixture further comprises at least one primary amide and wherein the heating temperature is lower than the melting point of the primary amide.

19. Powder metal composition according to claim 1 wherein said lubricant is capable of serving as a die wall lubricant.

20. Composition according to claim 2, wherein $R_1$ and $R_2$ are selected from the group consisting of alkyl and alkenyl.

* * * * *